United States Patent [19]

Kikuchi

[11] 4,310,153

[45] Jan. 12, 1982

[54] ELECTROSTATOGRAPHIC APPARATUS COMPRISING SHEET SENSORS

[75] Inventor: Hideo Kikuchi, Tokyo, Japan

[73] Assignee: Ricoh Company, Ltd., Tokyo, Japan

[21] Appl. No.: 65,251

[22] Filed: Aug. 9, 1979

[30] Foreign Application Priority Data

Aug. 14, 1978 [JP] Japan ..... 53-98913

[51] Int. Cl.[3] ..... B65H 7/14; B65H 7/20

[52] U.S. Cl. ..... 271/259; 271/111; 340/674; 250/223 R

[58] Field of Search ..... 271/259, 258, 110, 111; 355/35 SH; 340/674, 675, 676, 518; 250/223

[56] References Cited

U.S. PATENT DOCUMENTS 3,150,873 9/1964 MacGregor ..... 271/259

3,204,950 9/1965 Hanchett, Jr. ..... 271/259

3,988,730 10/1976 Valker ..... 340/518

*Primary Examiner*—Robert B. Reeves

*Assistant Examiner*—Brian Bond

*Attorney, Agent, or Firm*—David G. Alexander

[57] ABSTRACT

A plurality of sensors (61), (62), (63), (64) are spaced along a sheet feed path (14) to sense the presence of a copy sheet (13) adjacent thereto. A timing signal generator (53) feeds timing signals to the sensors (61), (62), (63), (64) at times when the sheet (13) should be present at the sensors (61), (62), (63), (64), the timing signals enabling the sensors respectively. The outputs of the sensors (61), (62), (63), (64) are connected in a wired-OR configuration to produce a logical sum output. Each sensor (61) typically comprises a light source (88), a photosensor (91) and a power switch such as a transistor (86). Each power switch (86) is constructed to connect the light source (88), the photosensor (91) or both to a power source (+V) in response to the respective timing signal.

4 Claims, 10 Drawing Figures

ELECTROSTATOGRAPHIC APPARATUS COMPRISING SHEET SENSORS

BACKGROUND OF THE INVENTION

The present invention relates to an electrostatographic apparatus such as an electrostatic copying machine comprising sensor means for sensing for the presence of a copy sheet at various locations along a sheet feed path and thereby sensing for a sheet jam.

In a typical electrostatic copying machine a copy sheet is fed through a sheet feed path for toner image transfer, fixing, discharge, etc. On occasion, a sheet will jam at some location along the sheet feed path and cause a malfunction of the feed system. It is desirable under these circumstances to shut down the copying machine as quickly as possible to limit the malfunction to a jam of only one sheet rather than several sheets which might actually damage the copying machine mechanism. It is also desirable to provide an indication of the location of the jam so that the jammed sheet may be removed quickly.

It has been practiced in the art to provide a plurality of sensors such as photosensors along the sheet feed path to sense for the presence of a copy sheet. The outputs of the sensors are connected through individual amplifiers and AND gates to an indicator means. A timing signal generator feeds timing pulses to the AND gates at times when the sheet should be present at the respective sensors, thus enabling the AND gates. If the sensor corresponding to an enabled AND gate produces a signal indicating absence of the sheet, this signal is gated through the AND gate to the indicator means to indicate a sheet jam. In other words, if a sensor produces an output indicating absence of the copy sheet at a time when the copy sheet should be present, it means that the sheet jammed or otherwise failed to be fed at a location upstream of the sensor. If the adjacent upstream sensor indicated presence of the sheet, it means that the sheet jammed between the adjacent upstream sensor and the sensor corresponding to the AND gate receiving the timing signal. This enables automatic indication of the location of the jam.

In a practical copying machine having a long sheet feed path, there may be provided on the order of 24 sensors along the sheet feed path. If a collation or sorting mechanism is provided, the number of sensors may be as high as 30 to 40. There will be further provided an amplifier and AND gate for each sensor. This results in an excessively large space requirement for the amplifiers and AND gates which are typically mounted on a printed circuit board and a complicated and expensive printed circuit board pattern. In addition, the power requirements for the amplifiers and sensors are unnecessarily high since only one or a few sensors are required to produce outputs at any one particular time.

SUMMARY OF THE INVENTION

An electrostatographic apparatus embodying the present invention includes sheet feed means for feeding a sheet through a sheet feed path, and is characterized by comprising a plurality of sensor means spaced from each other along the sheet feed path for sensing the presence of the sheet adjacent thereto, circuit means for producing a logical sum output of the sensor means, and timing signal generator means for generating and feeding timing signals to the sensor means at times when the sheet should be present at the sensor means, the timing signals enabling the sensor means respectively.

In accordance with the present invention, a plurality of sensors are spaced along a sheet feed path to sense the presence of a copy sheet adjacent thereto. A timing signal generator feeds timing signals to the sensors at times when the sheet should be present at the sensors, the timing signals enabling the sensors respectively. The outputs of the sensors are connected in a wired-OR configuration to produce a logical sum output. Each sensor typically comprises a light source, a photosensor and a power switch such as a transistor. Each power switch is constructed to connect the light source, the photosensor or both to a power source in response to the respective timing signal.

It is an object of the present invention to provide an electrostatographic apparatus comprising sheet sensors which operates in an efficient and reliable manner.

It is another object of the present invention to provide an electrostatographic apparatus comprising sheet sensors which requires substantially less electronic circuitry compared to the prior art.

It is another object of the present invention to provide an electrostatographic apparatus comprising sheet sensors which is substantially more compact than the prior art.

It is another object of the present invention to provide an electrostatographic apparatus comprising sheet sensors which requires substantially less electrical power than the prior art.

It is another object of the present invention to provide an electrostatographic apparatus comprising sheet sensors which may be manufactured easier and more economically on a commercial production basis than comparable apparatus known heretofore.

It is another object of the present invention to provide a generally improved electrostatographic apparatus comprising sheet sensors.

Other objects, together with the foregoing, are attained in the embodiments described in the following description and illustrated in the accompanying drawing.

DESCRIPTION OF THE PREFERRED EMBODIMENTS

While the electrostatographic apparatus comprising sheet sensors of the present invention is susceptible of numerous physical embodiments, depending upon the environment and requirements of use, substantial numbers of the herein shown and described embodiments have been made, tested and used, and all have performed in an eminently satisfactory manner.

Figure 1:
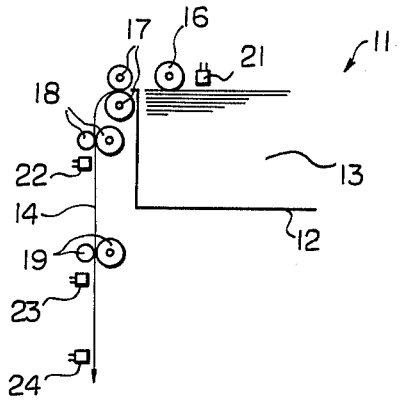
FIG. 1 is a fragmentary schematic diagram of a sheet feed path of an electrostatic copying machine and a plurality of sensors disposed in spaced relation along said path.

Referring now to FIG. 1 of the drawing, an electrostatographic apparatus 11 generally comprises a sheet tray or cassette 12 for holding a shack of copy sheets 13. The sheets 13 are fed one by one through a sheet feed path 14 by feed rollers 16, 17, 18 and 19. The roller 16 feeds the top sheet 13 from the stack into the bite of the feed rollers 17 which feed the top sheet 13 to the rollers 18 and prevent more than one sheet 13 from being fed. The rollers 18 and 19 feed the sheet 13 through the sheet feed path 14 to operating stations (not shown) where a toner image is transferred and fixed to the sheet 13 and the sheet 13 is finally discharged from the apparatus 11 as a finished copy.

A plurality of sensors are disposed along the sheet feed path 14 in spaced relation to sense for the presence of the sheet 13 adjacent thereto. A sensor 21 senses for the presence of the sheet 13 in the tray 12. A sensor 22 senses for the presence of the sheet 13 downstream of the rollers 18. A sensor 23 senses for the presence of the sheet 13 downstream of the rollers 19. A sensor 24 senses for the presence of the sheet 13 further downstream of the rollers 19. The particular location of the sensors is not the subject matter of the present invention and varies in accordance with the type of electrostatographic apparatus. Although only four sensors are shown and described, in a practical copying machine there will be provided on the order of 20 to 40 sensors.

Figure 2:
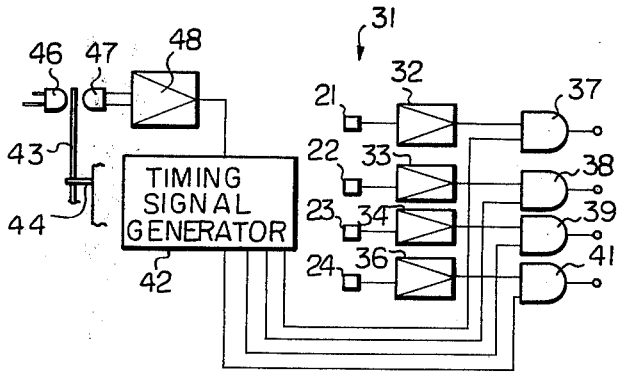
Fig. 2 PRIOR ART
FIG. 2 is a diagram illustrating a prior art sensor apparatus.

FIG. 2 illustrates a prior art apparatus 31 utilizing the sensors 21 to 24. The sensors 21 to 24 are preferably photosensor units each comprising a light source and a photosensor (not shown). The light source illuminates the location where the sheet 13 should be. If the sheet is present, the light will be reflected from the sheet 13 and impinge on the photosensor. If the sheet 13 is absent, no light will be reflected thereto. The outputs of the sensors 21 to 24 are connected through drive amplifiers 32, 33, 34 and 36 to inputs of AND gates 37, 38, 39 and 41 respectively. Other inputs of the AND gates 37, 38, 39 and 41 are connected to outputs of a timing signal generator 42.

A timing disc 43 is fixed to a shaft 44 which rotates in synchronism with a photoconductive drum (not shown). The disc 43 has a peripheral edge portion formed with an alternating pattern of opaque and transparent areas. A light source 46 and a photosensor 47 are disposed on opposite sides of the edge portion of the disc 43. The output of the photosensor 47 is connected through a drive amplifier 48 to an input of the timing signal generator 42. Due to the alternating arrangement of opaque and transparent areas, the photosensor 47, upon rotation of the disc 43, produces a generally sinusoidal output signal which is synchronized with the rotation of the drum. The sinusoidal signal is converted to a train of clock pulses by the amplifier 48.

In operation, the clock pulses are fed to the timing signal generator 42 which produces timing signals in response thereto. The generator 42 comprises a counter which counts the clock pulses and a decoder (not shown) which produces the timing signals at particular predetermined counts. The decoder is constructed to produce a timing signal when the sheet 13 should be adjacent to a particular sensor 21 to 24. The timing signal generator 42 further comprises a data distributor (not shown) which feeds the timing signals to the AND gates 37, 38, 39 and 41 on a selective basis.

For example, the generator 42 will feed the first timing signal to the AND gate 37 to sense whether the sheet 13 is present in the tray 12. The output of the sensor 21 will therefore be gated through the AND gate 37 to a control and indicator means (not shown). After feed of the sheet 13 begins and a number of clock pulses have been produced corresponding to movement of the copy sheet 13 from the tray 12 to the sensor 22, the generator 42 will feed a timing signal to the AND gate 38. The timing signals are in the form of short pulses. Thus, the output of the sensor 22 will be gated through the AND gate 38. The AND gates 39 and 41 are then supplied with timing signals in sequence when the sheet 13 should be adjacent to the sensors 23 and 24 respectively.

Although the prior art system of FIG. 2 is operative and produces the desired results, it requires a separate drive amplifier and AND gate for each sensor, resulting in an unnecessarily bulky and expensive configuration. In addition, power is supplied to all of the sensors and amplifiers even though only one each is actually being used, resulting in excessive and unnecessary consumption of electrical power.

Figure 3:
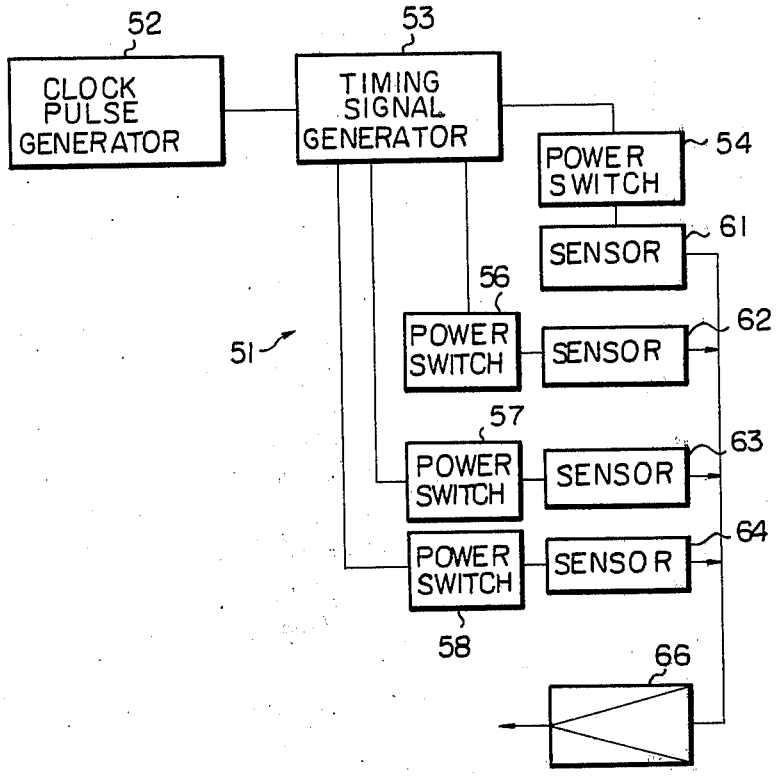
FIG. 3 is a block diagram of an electrostatographic apparatus embodying the present invention comprising sheet sensors such as illustrated in FIG. 1.

These drawbacks are overcome in accordance with the present invention as illustrated in FIG. 3. An electrostatographic apparatus embodying the present invention is generally designated by the reference numeral 51 and comprises a clock pulses generator 52. The output of the clock pulse generator 52 is connected to the input of a timing signal generator 53, outputs of which are connected to power switches 54, 56, 57 and 58 respectively. Outputs of the power switches 54, 56, 57 and 58 are connected to supply power to sensors 61, 62, 63 and 64 respectively. The outputs of the sensors 61, 62, 63 and 64 are connected together in a wired-OR configuration to produce a logical sum output which is connected to an input of a drive amplifier 66. The output of the amplifier 66 is connected to a control and indication means (not shown).

Figure 4:
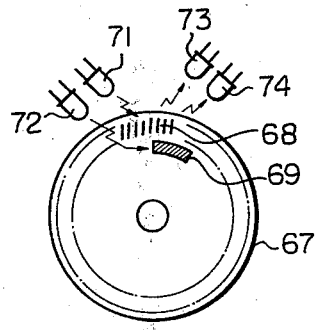
FIG. 4 is a diagram illustrating a timing disc and sensor arrangement.

The clock pulse generator 52 is shown in FIG. 4 as comprising a disc 67 which is rotated in synchronism with the drum. An alternating pattern of opaque and transparent areas is formed on the peripheral portion of the disc 67 as indicated at 68. A single mark 69 is provided inwardly of the pattern 68. Light sources 71 and 72 illuminate the pattern 68 and mark 69 respectively. Photosensors 73 and 74 receive transmitted or reflected light from the pattern 68 and mark 69 respectively. The photosensor 73 produces a sinusoidal output for shaping into clock pulses in the manner described with reference to FIG. 2. The mark 69 is designed to be adjacent to the photosensor 74 when feeding of the sheet 13 just begins. Thus, the photosensor 74 produces a start signal which resets a counter (not shown) in the generator 52 for counting the clock pulses. The clock pulse generator 52 and timing signal generator 53 operate in combination to produce timing signals in the manner described with reference to FIG. 2 at times when the sheet 13 is expected to be adjacent to the sensors 61, 62, 63 and 64 respectively. The positions of the sensors 61, 62, 63 and 64 correspond to the positions of the sensors 21, 22, 23 and 24 respectively.

Figure 5:
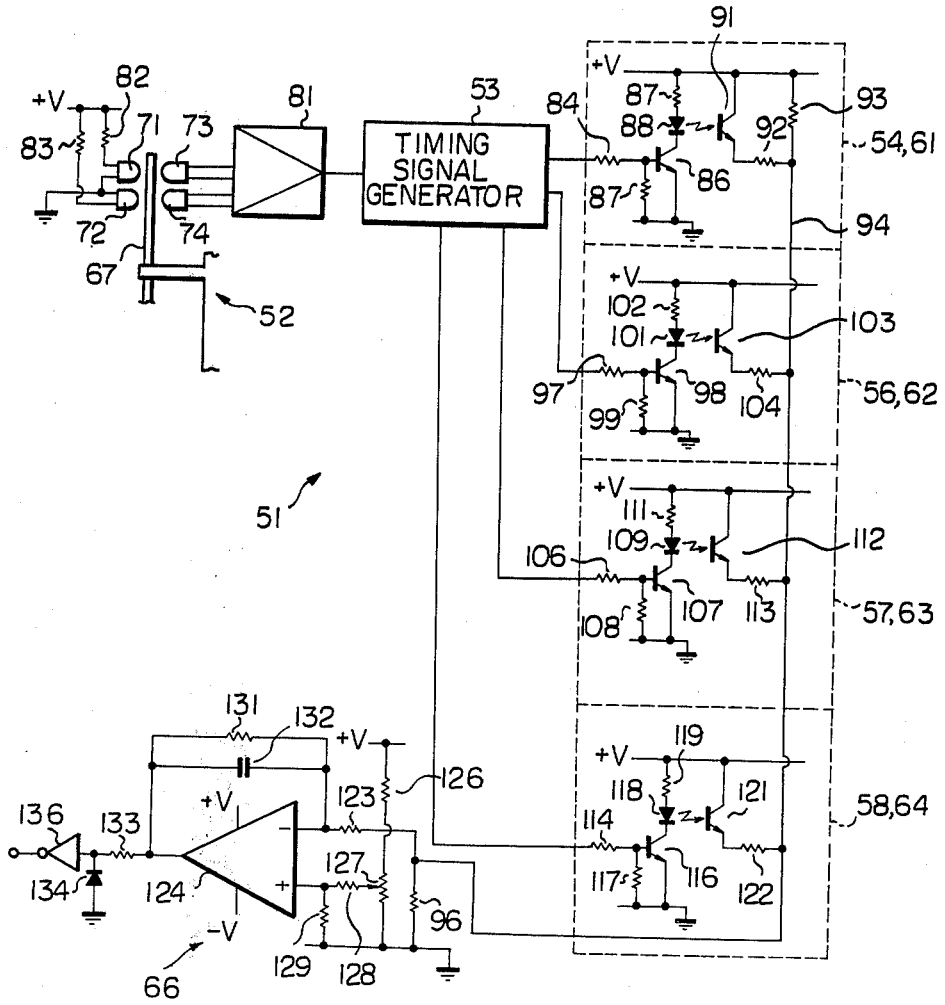
FIG. 5 is an electrical schematic diagram of the embodiment of the present invention illustrated in FIG. 3.
Figure 6:
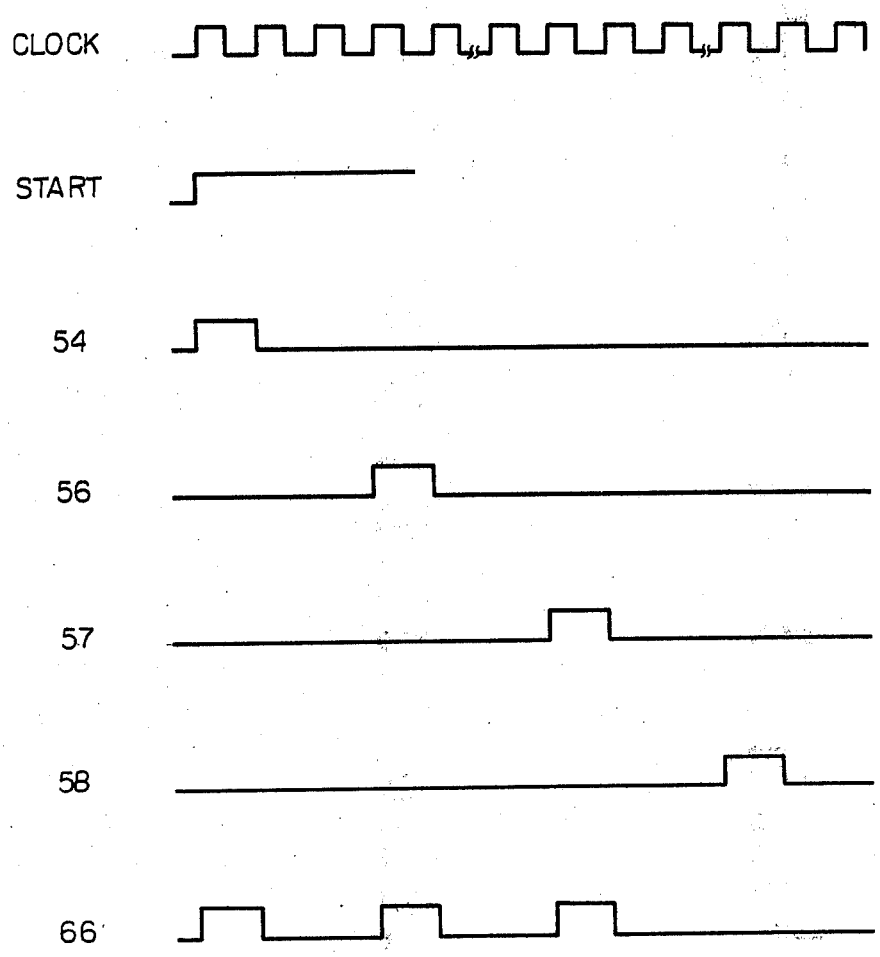
FIG. 6 is a timing diagram of the circuit of FIG. 5.

In operation, the clock pulse generator 52 produces the clock pulses and start pulses shown in FIG. 6. The timing signal generator 53 produces positive timing pulses or signals and feeds the same to the power switches 54, 56, 57 and 58 as shown in FIG. 6. In response to a timing signal, the respective power switch 54, 56, 57 or 58 is closed to supply power to the respective sensor 61, 62, 63 or 64 from a source which will be described below with reference to FIG. 5. Any sensor 61, 62, 63 or 64 which is not energized by a closed switch 54, 56, 57 or 58 respectively will produce a logically low output. In the example of FIG. 6, only one timing signal is produced at any one time to enable only one sensor.

The outputs of the sensors 61, 62, 63 and 64 are connected together in a wired-OR configuration so that a high input will be applied to the amplifier 66 if any one of the sensors 61, 62, 63 or 64 produces a high output. This arrangement produces the logical sum of the outputs of the sensors 61, 62, 63 and 64.

As shown in FIG. 6, it will be assumed that the sheet 13 reached the sensors 61, 62 and 63 at the times the corresponding timing signals were generated and the sensors 61, 62 and 63 produced high outputs. The amplifier 66 produced corresponding high outputs. However, if the sheet 13 jammed between the sensors 63 and 64 and therefore did not reach the sensor 64, the sensor 64 will not produce a high signal even though the power switch 58 is closed by the respective timing signal. Thus, the output of the sensor 64 and thereby the amplifier 66 will be low indicating the jam between the sensors 63 and 64.

The present apparatus 51 is advantageous over the prior art in that only one amplifier 66 and no AND gates are required. Power is supplied only to the sensor 61, 62, 63 or 64 for which the output is desired. This results in a highly substantial reduction in electronic circuitry, space requirements and power consumption.

A detailed electrical schematic diagram of the apparatus 51 is shown in FIG. 5. The light source 71 is constituted by a light emitting diode connected in series with a current limiting resistor 82 between a positive D.C. power source +V and ground. The light source 72 is similar to the light source 71 and is connected in series with a resistor 83 between the source +V and ground. The ground connection is arbitrary and exemplary.

The photosensors 73 and 74 are constituted by photodiodes, phototransistors, photocells, photoresistors or the like and are connected through a drive amplifier 81 to the timing signal generator 53.

The output of the timing signal generator 53 corresponding to the power switch 54 and sensor 61 is connected through a resistor 84 to the base of an NPN switching transistor 86. The base of the transistor 86 is also connected to ground through a resistor 87. The emitter of the transistor 86 is grounded. The collector of the transistor 86 is connected to the anode of a light emitting diode 88 which constitutes part of the sensor 61. The anode of the diode 88 is connected through a resistor 89 to the power source +V.

The light emitting diode 88 is arranged to illuminate the sheet 13. An NPN phototransistor 91 is disposed to receive light from the diode 88 reflected from the sheet 13. The collector of the transistor 91 is connected to the source +V. The emitter of the transistor 91 is connected through a resistor 92 to an output line 94. A resistor 93 is connected between the source +V and the output line 94. A resistor 96 is connected between the output line 94 and ground.

The output of the timing signal generator 53 corresponding to the power switch 56 and sensor 62 is connected through a resistor 97 to the base of an NPN switching transistor 98. The base of the transistor 98 is also connected to ground through a resistor 99. The emitter of the transistor 98 is grounded. The collector of the transistor 98 is connected to the anode of a light emitting diode 101 which constitutes part of the sensor 62. The anode of the diode 101 is connected through a resistor 102 to the power source +V.

The light emitting diode 101 is arranged to illuminate the sheet 13. An NPN phototransistor 103 is disposed to receive light from the diode 101 reflected from the sheet 13. The collector of the transistor 103 is connected to the source +V. The emitter of the transistor 103 is connected through a resistor 104 to the output line 94.

The output of the timing signal generator 53 corresponding to the power switch 57 and sensor 63 is connected through a resistor 106 to the base of an NPN switching transistor 107. The base of the transistor 107 is also connected to ground through a resistor 108. The emitter of the transistor 107 is grounded. The collector of the transistor 107 is connected to the anode of a light emitting diode 109 which constitutes part of the sensor 63. The anode of the diode 109 is connected through a resistor 111 to the power source +V.

The light emitting diode 109 is arranged to illuminate the sheet 13. An NPN phototransistor 112 is disposed to receive light from the diode 109 reflected from the sheet 13. The collector of the transistor 112 is connected to the source +V. The emitter of the transistor 112 is connected through a resistor 113 to the output line 94.

The output of the timing signal generator 53 corresponding to the power switch 58 and sensor 64 is connected through a resistor 114 to the base of an NPN switching transistor 116. The base of the transistor 116 is also connected to ground through a resistor 117. The emitter of the transistor 116 is grounded. The collector of the transistor 116 is connected to the anode of a light emitting diode 118 which constitutes part of the sensor 64. The anode of the diode 118 is connected through a resistor 119 to the power source +V.

The light emitting diode 118 is arranged to illuminate the sheet 13. An NPN phototransistor 21 is disposed to receive light from the diode 118 reflected from the sheet 13. The collector of the transistor 121 is connected to the source +V. The emitter of the transistor 121 is connected through a resistor 122 to the output line 94.

The junction of the resistors 93 and 96 is connected through a resistor 123 to the inverting input of an operational amplifier 124 which constitutes the active element of the amplifier 66. A fixed resistor 126 is connected in series with a potentiometer 127 between the source +V and ground. The slider of the potentiometer 127 is connected through a resistor 128 to the non-inverting input of the operational amplifier 124. The non-inverting input of the operational amplifier 124 is also connected to ground through a resistor 129.

The operational amplifier 124 is powered by the positive source +V and also a negative source −V. The output of the operational amplifier 124 is connected to the inverting input thereof through the parallel connection of a feedback resistor 131 and capacitor 132. The output of the operational amplifier 124 is connected through a resistor 133 to the cathode of a zener diode 134. The anode of the zener diode 134 is grounded. The cathode of the zener diode is connected to an input of an inverter 136, the output of which constitutes the output of the amplifier 66.

An adjustable reference voltage is applied to the non-inverting input of the operational amplifier 124 from the slider of the potentiometer 127. The operational amplifier 124 operates as a differential amplifier. When the voltage at the inverting input of the operational amplifier 124 corresponding to the signal on the output line 94 is lower than the voltage at the non-inverting input thereof, the operational amplifier 124 produces a positive output. The zener diode 134 limits the voltage at the input of the inverter 136 to the zener voltage of the diode 134. The inverter 136 produces a low output in response to a high output from the operational amplifier 124. In summary, the inverter 136 produces a low output in response to a low signal on the output line 94.

When the signal on the line 94 is higher than the reference voltage, the operational amplifier 124 produces a negative output. However, the input of the inverter 136 is clamped to substantially zero volts by the zener diode 134 which is forward biased under these circumstances. Thus, the inverter 136 produces a high output. In summary, the output of the inverter 136 is high if the signal on the line 94 is high.

When the timing signal generator 53 does not feed a timing signal to any of the power switches 54, 56, 57 or 58, the voltage on the line 94 will be low. Detailed description of only the power switch 54 and sensor 61 will be made since the power switch and sensor combinations 56, 62, 57, 63 and 58, 64 are identical.

When the signal from the timing signal generator 53 which appears at the base of the transistor 86 is low, the transistor 86 is turned off. Current flow through the diode 88 is blocked and the diode 88 does not emit light to illuminate the sheet 13. Thus, the phototransistor 91 will be turned off.

The resistors 93 and 96 constitute a voltage divider between the source +V and ground, with the voltage at the junction thereof being applied to the operational amplifier 124. The values of the resistors 93 and 96 are selected so that under these conditions the voltage at the junction of the resistors 93 and 96 is lower than the reference voltage at the slider of the potentiometer 127. Thus, the output of the operational amplifier is high and the output of the inverter 136 is low.

Next, it will be assumed that the timing signal generator 53 applies a timing signal to the transistor 86 but there is no sheet 13 adjacent to the diode 88 and transistor 91. This is a jam condition. The transistor 86 is turned on and passes current through the diode 88. The diode 88 emits light to illuminate the sheet 13. However, since the sheet 13 is absent, no light is reflected to the phototransistor 91 so the transistor 91 remains turned off. The inverter 136 produces a low output indicating a jam.

The last condition occurs when the timing signal is fed to the transistor 86 and the sheet 13 is present. The diode 88 emits light which is reflected to the transistor 91. The transistor 91 conducts and completes a shunt path across the resistor 93 in series with the resistor 92.

In order to produce a low output on the line 94 when the timing signals are not generated, the value of the resistor 93 is made large and the value of the resistor 96 is made small. The value of the resistor 92 is selected to be small in comparison with the value of the resistor 96. Thus, conduction of the transistor 91 produces a shunt path in parallel with the resistor 93 which has a low resistance compared to the value of the resistor 96. As a result, the voltage on the line 94 goes high and the inverter 136 produces a high output.

In summary, the output voltage of the inverter 136 is low when no timing signals are generated and also when a timing signal if generated but there is no sheet 13 at the respective sensor. The output of the inverter is high when a timing signal is generated and there is a sheet 13 at the respective sensor.

Figure 7:
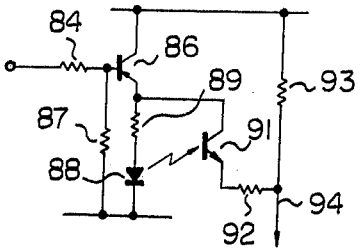
FIG. 7 is a fragmentary electrical schematic diagram illustrating a modification of the circuitry of FIG. 5.

It will be noted that in the apparatus 51, the switch transistor 86 which constitutes the power switch 54 functions to switch power to the light emitting diode 88 in response to the timing signal. FIG. 7 shows another arrangement in which the transistor 86 functions to switch power to both the light emitting diode 88 and the phototransistor 91 in response to the timing signal. Like elements are designated by the same reference numerals although the elements are rearranged.

When the timing signal is not applied to the base of the transistor 86, the transistor 86 is turned off. The collector of the phototransistor 91 and the anode of the light emitting diode 88 are both connected to the source +V through the collector circuit of the transistor 86. However, with the transistor 86 turned off, there is no current flow and the diode 88 and transistor 91 are inhibited. However, when the positive timing signal is applied to the base of the transistor 86, the transistor 86 is turned on and connects the diode 88 and transistor 91 to the source +V.

Figure 8:
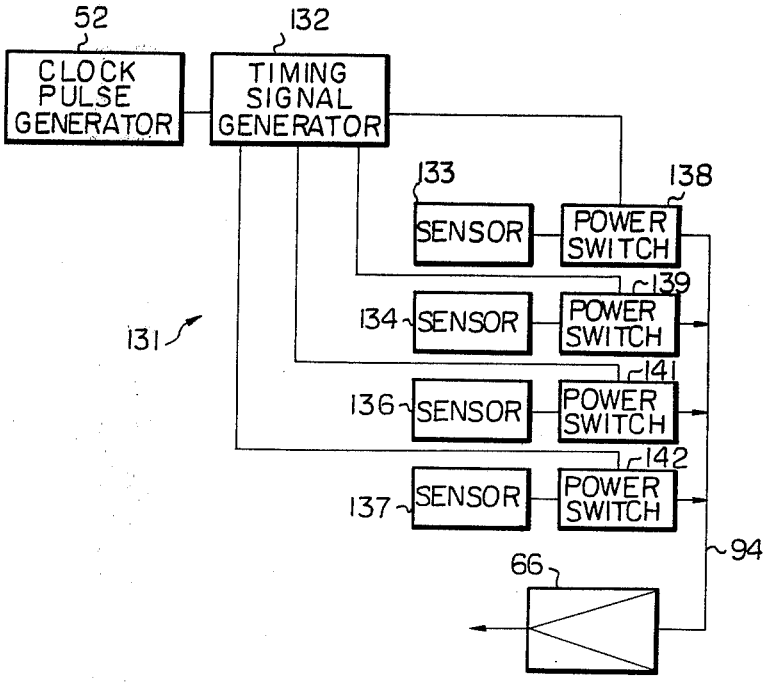
FIG. 8 is similar to FIG. 3 but illustrates another embodiment of the present invention.
Figure 10:
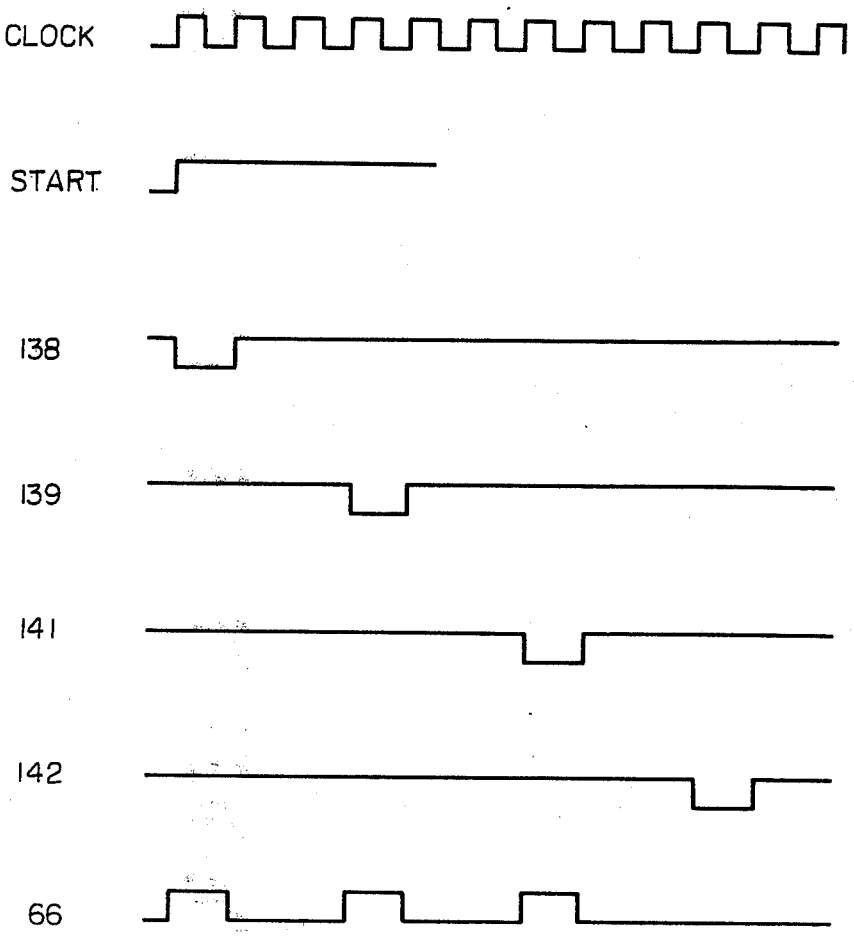
FIG. 10 is a timing diagram of the circuit of FIG. 9.

Another embodiment of the present invention is illustrated in FIG. 8 and designated as 131. The same clock pulse generator 52 is used and is connected to a timing signal generator 132 which is similar to the generator 53 except that the generator 132 generates low timing signals rather than high timing signals as shown in FIG. 10.

Outputs of sensors 133, 134, 136 and 137 are connected through power switches 138, 139, 141 and 142 in a wired-OR configuration to the output line 94. In response to the timing signals, the power switches 138, 139, 141 and 142 close to connect the outputs of the respective sensors 133, 134, 136 and 137 to the line 94.

Figure 9:
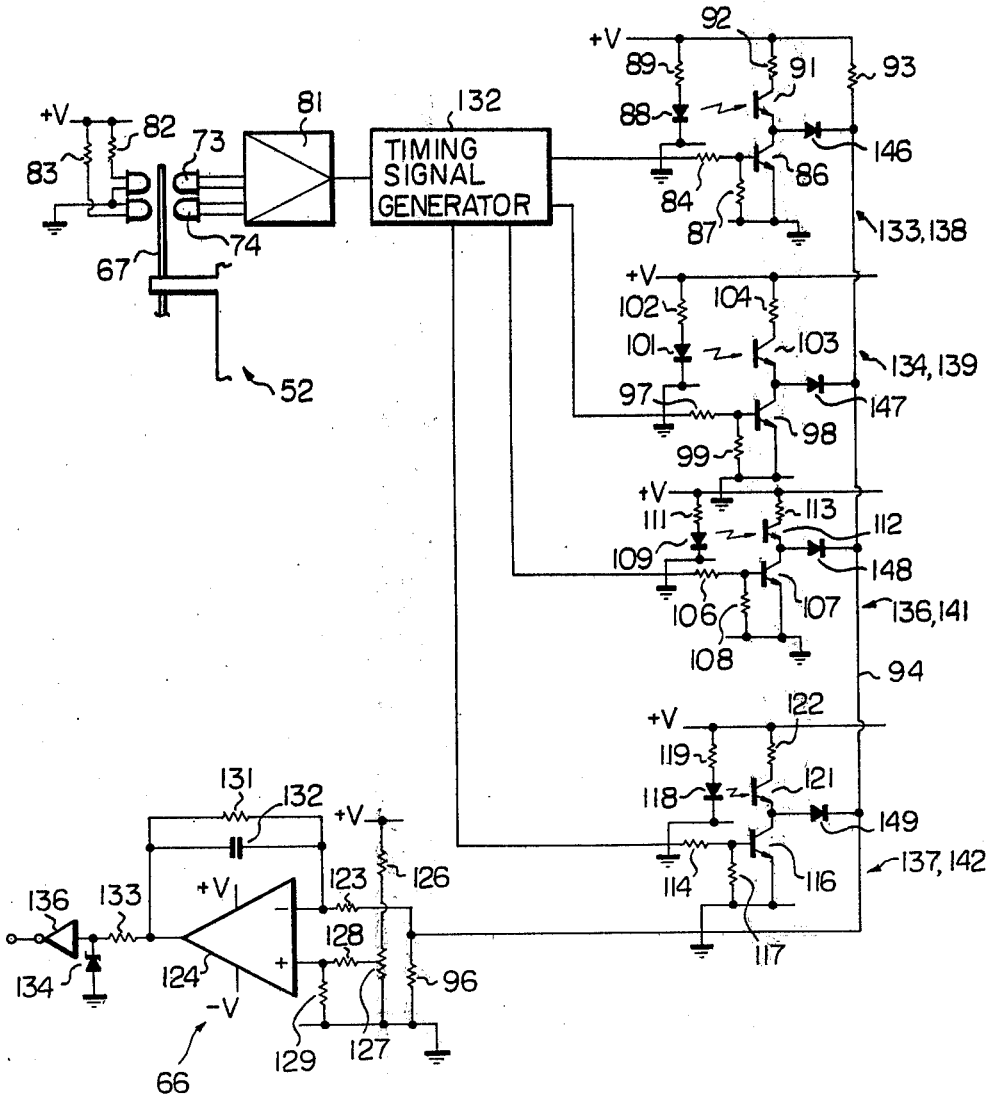
FIG. 9 is an electrical schematic diagram of the embodiment of FIG. 8.

A detailed circuit diagram of the apparatus 131 is shown in FIG. 9, with like elements being designated by the same reference numerals used in FIG. 5. The elements of the sensor 133 and power switch 138 are rearranged so that the cathode of the diode 88 is grounded and the diode 88 is continuously energized. The collector of the transistor 91 is connected to the source +V through the resistor 92. The collector of the transistor 86 is connected to the emitter of the transistor 91. The configurations of the units 134,139, 136,141 and 137,142 are identical. The collectors of the transistors 86, 98, 107 and 116 are connected to the anodes of diodes 146, 147, 148 and 149 respectively, the cathodes of the diodes being connected to the line 94.

With no low timing signal applied to the transistor 86 (the voltage at the base of the transistor 86 is high), the transistor 86 is turned on and connects the emitter of the transistor 91 to ground. Thus, the line 94 will be low when no timing signals are generated.

When the low timing signal is applied to the transistor 86, the transistor 86 is turned off and disconnects the emitter of the transistor 91 from ground. With the transistor 86 turned on, the diode 146 is reverse biased and prevents the transistor 86 from affecting the voltage on the line 94. If no sheet 13 is present when the timing signal is generated, the transistor 91 will not conduct and the voltage on the line 94 will remain low. However, if the sheet 13 is present, the transistor 91 will conduct and connect the line 94 to the source +V through the diode 146 which is in this case forward biased. Thus, the voltage on the line 94 and the output of the inverter 136 will go high. In the apparatus 131, the power switch 86 connects the phototransistor 91 to the power source +V in response to the timing signal.

In summary, it will be seen that the present invention overcomes the drawbacks of the prior art and provides an electrostatographic apparatus comprising sheet jam sensors which is less complicated, costly and bulky than prior art apparatus but still operates efficiently and reliably. Various modifications will become possible for those skilled in the art after receiving the teachings of the present disclosure without departing from the scope thereof. For example, the outputs of the sensors may be connected to inputs of an OR gate rather than being connected in a wired-OR configuration.

What is claimed is:

1. An electrostatographic apparatus including sheet feed means for feeding a sheet through a sheet feed path, characterized by comprising:

a plurality of sensor means spaced from each other along the sheet feed path for sensing the presence of the sheet adjacent thereto;

circuit means for producing a logical sum output of the sensor means;

timing signal generator means for generating and feeding timing signals to the sensor means at times when the sheet should be present at the sensor means, the timing signals enabling the sensor means respectively;

each sensor means comprising a light source and a photosensor; and power source means for powering the light source and photosensor;

each sensor means further comprising switch means for connecting the light source to the power source means in response to the respective timing signal.

2. An apparatus as in claim 1, in which the circuit means is constituted by outputs of the sensor means connected in a wired-OR configuration.

3. An apparatus as in claim 1, further comprising an amplifier connected to an output of the circuit means.

4. An electrostatographic apparatus including sheet feed means for feeding a sheet through a sheet feed path, characterized by comprising:

a plurality of sensor means spaced from each other along the sheet feed path for sensing the presence of the sheet adjacent thereto;

circuit means for producing a logical sum output of the sensor means;

timing signal generator means for generating and feeding timing signals to the sensor means at times when the sheet should be present at the sensor means, the timing signals enabling the sensor means respectively;

each sensor means comprising a light source and a photosensor; and power source means for powering the light source and photosensor;

each sensor means further comprising switch means for connecting the photosensor to the power source means in response to the respective timing signal.

* * * * *